US010494916B2

(12) United States Patent
White et al.

(10) Patent No.: US 10,494,916 B2
(45) Date of Patent: Dec. 3, 2019

(54) SUB-SURFACE ELECTROMAGNETIC TELEMETRY SYSTEMS AND METHODS

(71) Applicant: Scientific Drilling International, Inc., Houston, TX (US)

(72) Inventors: Matthew A. White, Templeton, CA (US); Brian Gleason, Atascadero, CA (US); Stephen D. Morrow, Paso Robles, CA (US); Peter Smidth, San Luis Obispo, CA (US); Larry J. Schoennauer, Paso Robles, CA (US); Douglas Ridgway, Edmonton (CA)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 10 days.

(21) Appl. No.: 15/433,695

(22) Filed: Feb. 15, 2017

(65) Prior Publication Data

US 2017/0241259 A1 Aug. 24, 2017

Related U.S. Application Data

(60) Provisional application No. 62/297,691, filed on Feb. 19, 2016, provisional application No. 62/299,872, filed on Feb. 25, 2016.

(51) Int. Cl.

| | |
|---|---|
| ***E21B 47/12*** | (2012.01) |
| ***E21B 17/10*** | (2006.01) |
| ***E21B 17/00*** | (2006.01) |
| ***E21B 47/04*** | (2012.01) |

(52) U.S. Cl.
CPC ..... *E21B 47/122* (2013.01); *E21B 17/003* (2013.01); *E21B 17/10* (2013.01); *E21B 47/04* (2013.01)

(58) Field of Classification Search
None
See application file for complete search history.

(56) References Cited

U.S. PATENT DOCUMENTS

| | | | |
|---|---|---|---|
| 4,994,747 | A | 2/1991 | Stolarczyk |
| 5,597,042 | A | 1/1997 | Tubel et al. |
| 5,812,068 | A | 9/1998 | Wisler et al. |
| 6,075,462 | A | 6/2000 | Smith |

(Continued)

FOREIGN PATENT DOCUMENTS

WO 2015099785 A1 7/2015

OTHER PUBLICATIONS

International Search Report and Written Opinion issued in Application No. PCT/US17/17950, dated Jun. 7, 2017, 15 pages.

(Continued)

*Primary Examiner* — John F Mortell
(74) *Attorney, Agent, or Firm* — Adolph Locklar

(57) ABSTRACT

A method may include drilling a section of a first wellbore and casing a section of a first wellbore. The method may include lowering a downhole receiving system into the first wellbore to a first wellbore depth and drilling at least one section of a second wellbore. In addition, the method may include positioning an EM telemetry system in the at least one section of the second wellbore and transmitting an EM telemetry signal from the EM telemetry system. The method may include receiving the EM telemetry signal with the downhole receiving system.

67 Claims, 5 Drawing Sheets

(56) References Cited

U.S. PATENT DOCUMENTS

| | | | | |
|---|---|---|---|---|
| 6,188,222 | B1 * | 2/2001 | Seydoux | E21B 47/12 324/339 |
| 6,188,223 | B1 | 2/2001 | Van Steenwyk et al. | |
| 9,459,371 | B1 * | 10/2016 | Holmen | E21B 47/122 |
| 2004/0069514 | A1 | 4/2004 | Rodney et al. | |
| 2004/0156264 | A1 | 8/2004 | Gardner et al. | |
| 2007/0052551 | A1 | 3/2007 | Lovell et al. | |
| 2009/0251331 | A1 | 10/2009 | Wassermann et al. | |
| 2011/0168446 | A1 | 7/2011 | Lemenager et al. | |
| 2012/0133367 | A1 | 5/2012 | Bittar et al. | |
| 2013/0099808 | A1 | 4/2013 | Li et al. | |
| 2013/0239673 | A1 | 9/2013 | Garcia-Osuna et al. | |
| 2013/0241742 | A1 * | 9/2013 | Contant | G01V 3/30 340/854.6 |
| 2017/0328195 | A1 * | 11/2017 | Wilson | E21B 47/122 |
| 2018/0038222 | A1 * | 2/2018 | Samson | E21B 47/0005 |

OTHER PUBLICATIONS

K.-M. Cheung, "Eigen Theory for Optimal Signal Combining: A Unified Approach" TDA Progress Report 42-126, Aug. 15, 1996, pp. 1-9.

Nitika Sachdeva et al., "Performance Analysis of Conventional Diversity Combining Schemes in Rayleigh Fading Channel" International Journal of Advanced Research in Computer Science and Software Engineering, vol. 2, Issue 6, Jun. 2012, pp. 197-201.

Jashvir Chhikara et al., "Noise cancellation using adaptive algorithms" International Journal of Modern Engineering Research, vol. 2, Issue.3, May-Jun. 2012 pp. 792-795.

Bengt Holter et al., "The Optimal Weights of a Maximum Ratio Combiner Using an Eigenfilter Approach"; (2002).

Jack H. Winters, "Optimum Combining in Digital Mobile Radio with Cochannel Interference", IEEE Journal on Selected Areas in Communications, vol. SAC-2, No. 4, Jul. 1984, pp. 528-539.

Schnitger, et al., "Signal Attenuation for Electromagnetic Telemetry Systems", SPE/IADC 118872, 2009.

* cited by examiner

SUB-SURFACE ELECTROMAGNETIC TELEMETRY SYSTEMS AND METHODS

CROSS-REFERENCE TO RELATED

This application is a non-provisional application which claims priority from U.S. provisional application No. 62/297,691, filed Feb. 19, 2016, and U.S. provisional application No. 62/299,872, filed Feb. 25, 2016, both of which are incorporated by reference herein in their entirety.

TECHNICAL FIELD/FIELD OF THE DISCLOSURE

The present disclosure relates generally to wellbore communications and more specifically to transmitting data between a downhole location and the surface or between the surface and a downhole location.

BACKGROUND OF THE DISCLOSURE

During a drilling operation, data may be transmitted from a downhole transmitter located on a downhole tool included as part of the bottom hole assembly (BHA) of a drill string positioned in a wellbore. Data transmitted from the downhole transmitter may include, for instance, properties of the surrounding formation, downhole conditions, status of downhole equipment, orientation of the downhole equipment, and the properties of downhole fluids. Electronics present in the BHA may be used for transmission of data to the surface, collecting data using sensors such as vibration sensors, magnetometers, inclinometers, accelerometers, nuclear particle detectors, electromagnetic detectors, and acoustic detectors, acquiring images, measuring fluid flow, determining direction, emitting signals, particles or fields for detection by other devices, interfacing with other downhole equipment, and sampling downhole fluids. The BHA may also include mud motors and steerable drilling systems, such as a rotary steerable system (RSS), which may be used to steer the wellbore as the wellbore is drilled. By receiving data from the BHA, an operator may have access to the data collected by the sensors.

The drill string can extend thousands of feet below the surface. Typically, the bottom end of the drill string includes a drill bit for drilling the wellbore. Drilling fluid, such as drilling mud, may be pumped through the drill string. The drilling fluid typically cools and lubricates the drill bit and may carry cuttings back to the surface. Drilling fluid may also be used for control of bottom hole pressure. In situations where the formation may be damaged by the pressure generated by the column of drilling fluid, mist or foam may be used to reduce the pressure on the formation due to the fluid column.

Examples of telemetry systems for transmitting data to the surface include mud pulse (MP), electromagnetic (EM), hardwired drill pipe, fiber optic cable, and drill collar acoustic systems. Traditionally, MP and EM telemetry may be less expensive to deploy than hardwired drill pipe, fiber optic cable and drill collar acoustic systems. An EM system may operate when pumps are not operating to circulate fluid through the drill string, which, in certain operations, may be necessary for use of MP systems. In certain traditional uses, an EM telemetry system may transmit data at a higher data rate compared to an MP system. EM systems may also operate when foam or mist are used as a drilling fluid which may hinder the generation or reception of mud pulses of sufficient amplitude for reliable MP telemetry. EM systems may be limited in depth of reliable operation due to attenuation of the signal received at surface, i.e., EM signals, may be reduced to an amplitude that is below the noise level generated by various pieces of drilling equipment used to drill the well.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

SUMMARY

Figure 1:
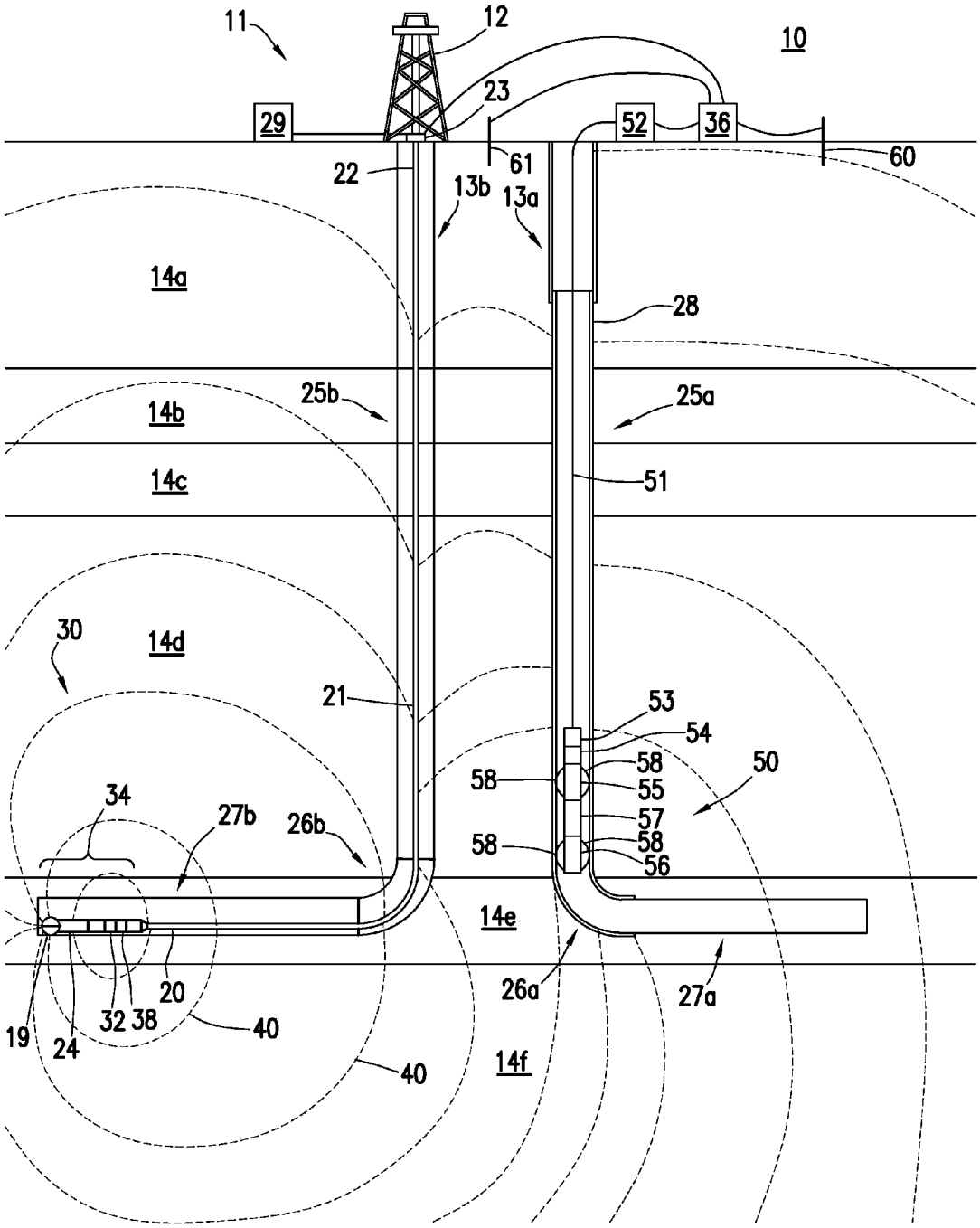
FIG. 1 is a schematic view of a drilling system consistent with embodiments of the present disclosure.

The present disclosure provides for a method. The method includes drilling a section of a first wellbore and casing a section of a first wellbore. The method also includes lowering a downhole receiving system into the first wellbore to a first wellbore depth and drilling at least one section of a second wellbore. In addition, the method includes positioning an EM telemetry system in the at least one section of the second wellbore and transmitting an EM telemetry signal from the EM telemetry system. The method also includes receiving the EM telemetry signal with the downhole receiving system.

The present disclosure provides for a system. The system includes a downhole receiving system positioned in a first wellbore at a first wellbore depth, the downhole receiving system suspended from a wireline. The wireline has a sheath and an insulated conductor. The downhole receiving system is configured to operate as an electrode. The system also includes an uplink receiver and an EM telemetry system positioned in a second wellbore. The EM telemetry system having an uplink transmitter, the uplink transmitter located at a second wellbore depth.

The present disclosure provides for a method. The method includes providing a downhole receiving system, the downhole receiving system configured to operate as an electrode. In addition, the method includes suspending the downhole receiving system from a wireline at a first wellbore depth, the wireline having a sheath and an insulated conductor. The method may also include locating an uplink receiver at the surface, the uplink receiver in electrical communication with the downhole receiving system. In addition, the method includes positioning an EM telemetry system in a second wellbore, the EM telemetry system having an uplink transmitter, the uplink transmitter located at a second wellbore depth. Further, the method includes positioning a plurality of pairs of surface electrodes at the surface and switching the uplink receiver from a first pair of electrodes at the surface to a second pair of electrodes at the surface, or from the insulated conductor to one of a pair of the plurality of electrodes.

DETAILED DESCRIPTION

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling site 10, where drilling system 11 may drill multiple wellbores. In certain embodiments, the wellbores may be drilled in succession, that is, a first wellbore may be drilled, followed later in time by a second wellbore and, in some embodiments, by subsequent wellbores. Drilling system 11 may include one or more drilling rigs 12 used to drill, in succession, a first wellbore 13*a*, a second wellbore 13*b* and, in certain embodiments, additional wellbores (such as, but not limited to, a third wellbore, fourth wellbore, etc.) at drilling site 10. One or more drilling rigs 12 may drill wellbores 13*a* and 13*b* through, for instance, formations 14*a*, 14*b*, 14*c*, 14*d* and into target formation 14*e* located above formation 14*f*. FIG. 1 depicts wellbore 13*b* being drilled with drill bit 19 positioned at bottom end 20 of drill string 21. Drill string 21 is supported at upper section 22 by drilling equipment 23. Drill bit 19 may be rotated by a fluid motor, such as mud motor 24. Drilling equipment 23 may pump fluid, such as drilling mud, foam, or mist through drill string 21 to drill bit 19, rotate drill string 21, raise and lower drill string 21 within wellbore 13*b*, provide emergency pressure isolation in the event of a high pressure kick encountered during drilling such as performed by a blow out preventer (BOP), in addition to other functions related to drilling of wellbore 13*b*. Portions of drilling equipment 23 may be powered by generator 29. Wellbore 13*a* and 13*b* are shown as horizontal wellbores consisting of vertical sections 25*a* and 25*b*, respectively, curve sections 26*a* and 26*b*, respectively and horizontal sections 27*a* and 27*b* respectively. Wellbores 13*a* and 13*b* are exemplary and one of ordinary skill in the art with the benefit of this disclosure will recognize that other configurations are contemplated by this disclosure. Wellbores 13*a* and 13*b* may be vertical wells, slant wells, S shaped wells, multi-lateral wells, or any other well shape known within the art. Wellbore 13*a* may be configured differently than wellbore 13*b*. FIG. 1 also depicts wellbores 13*a* and 13*b* as landing horizontal sections, 27*a* and 27*b*, respectively, into the same target formation 14*e*. In some embodiments target formations for wellbores 13*a* and 13*b* may differ.

FIG. 1 depicts wellbore 13*a* as having been drilled in its entirety, extending through the full range of horizontal section 27*a*. In some embodiments, wellbore 13*a* may be only partially drilled when drilling of wellbore 13*b* commences. For example, drilling rig 12 may successively drill vertical section 25*a* and curve section 26*a* of wellbore 13*a* followed by vertical section 25*b* and curve section 26*b* of wellbore 13*b* followed by the vertical sections and curve sections of any additional wellbores drilled at drilling site 10. After drilling all vertical sections and curve sections for all of the wellbores drilled at drilling site 10, drilling rig 12 may successively drill horizontal section 27*a* of wellbore 13*a* followed by horizontal 27*b* of wellbore 13*b* followed by the horizontal section of any other wellbores drilled at drilling site 10.

Drilling system 11 may include an EM telemetry system 30. EM telemetry system 30 may include one or more uplink transmitters 32 located on BHA 34 for transmitting an EM signal to uplink receiver 36 located at the surface. In some embodiments, BHA 34 includes electric current generator 38, which, causing current to flow within BHA 34 and drill string 21 and into the surrounding formations as depicted diagrammatically by lines of current 40. Electrical current generator 38 may be, for example and without limitation, an electrically insulating gap across which a voltage is impressed or a toroid for inducing currents within BHA 34 and drill string 21.

In the embodiment shown in FIG. 1, casing string 28 is installed in wellbore 13*a*, referred to herein as "casing" a wellbore. In certain embodiments, sections of wellbore 13*a* may be cased. Casing string 28 may consist of multiple segments of conductive tubular pipe of the same or different diameters that may be cemented into wellbore 13*a*. Without being bound by theory, the lower resistance of casing string 28 as compared to the surrounding formations may concentrate the currents of EM telemetry system 30 due to the tendency for electrical currents to take the path of least resistance. Downhole receiving system 50 may be located within wellbore 13*a*, suspended on wireline 51 by wireline unit 52 located at the surface, for instance, to locate downhole receiving system 50 in depth proximity to EM telemetry system 30. Wireline unit 52 may include equipment for lowering downhole receiving system 50, such as winch and motor, transmission equipment for communicating data to uplink receiver 36 and a depth measurement system. Depth proximity refers to equipment at the same approximate depth from the surface. For example, and without limitation, when downhole receiving system 50 is in depth proximity to EM telemetry system 30, downhole hole receiving system 50 and EM telemetry system 30 may be within 1000 feet, 500 feet or 200 feet of the same depth from the surface. The depth proximity of downhole receiving system 50 to the source of the EM telemetry signal of EM telemetry system 30 and the current concentrating effect of casing string 28 may operate to increase the signal strength received by downhole receiving system 50 as compared to the signal at surface. Such positioning of downhole receiving system 50 to the source of EM telemetry system 30 may allow the receiving system to operate reliably at greater depths than if the receiving system were located at the surface.

In some embodiments, casing string 28 may include one or more sections of non-conductive tubular pipe. A non-conductive section of casing string 28 may increase the resistance across which an EM telemetry signal of EM telemetry system 30 may be received. The non-conductive section of casing string 28 may be made of, for example and without limitation, carbon fiber, or any other substantially non-conductive material with suitable yield and tensile strength.

In some embodiments, wireline unit 52 may lower downhole receiving system 50 to a depth proximate uplink transmitter 32 of EM telemetry system 30 as drilling system 11 drills wellbore 13*b*. In such embodiments, the signal strength received at uplink receiver 36 may be increased by following the progression of BHA 34 with downhole receiving system 50 as BHA 34 descends into wellbore 13*b*. Operation of motors in wireline unit 52 to lower downhole receiving system 50 into wellbore 13*a* may produce noise, which may corrupt a received signal, i.e., the EM telemetry signal received by downhole receiving system 50. In certain embodiments, to reduce the corruption of the received signal, the operation of lowering downhole receiving system 50 within wellbore 13*a* may be performed at discrete depth intervals rather than continuously. Repositioning of downhole receiving system 50 may occur at intervals of approximately 2000 ft or at intervals of approximately 1000 ft or as little as approximately 200 ft. Once wireline unit 52 has lowered downhole receiving system 50 to a depth at which the received signal strength or signal to noise ratio is observed to be near its maximum, motors and generators of wireline unit 52 may be turned off and a brake engaged to avoid inducing noise from the motors and generators into the received signal.

In some embodiments, wireline unit 52 lowers downhole receiving system 50 into wellbore 13*a* to a predetermined depth after which any additional length of wireline 51 may be cut off and the portion left in wellbore 13*a* tied off at surface to suspend wireline 51 and downhole receiving system 50 in wellbore 13*a*, thereby maintaining downhole receiving system 50 at the predetermined depth. In embodiments where downhole receiving system 50 is lowered to a predetermined depth, the received telemetry signal may be of lower amplitude than embodiments where wireline unit 52 lowers downhole receiving system 50 into wellbore 13*a* so as to follow uplink transmitter 32 as it descends wellbore 13*b*. However, cutting off the excess length of wireline 51 allows wireline unit 52 to be moved from drilling site 10 and used in a different location during drilling of wellbore 13*b* or any additional wellbores drilled at drilling site 10. In some embodiments, the predetermined depth selected for positioning of downhole receiving system 50 may be based on the estimated depth at which the signal received across a pair of surface electrodes at uplink receiver 36 drops into the noise level making telemetry unreliable. This determination may be made, for instance during drilling of wellbore 13*a*, drilling of a section of wellbore 13*b*, or drilling of other wellbores at other drilling sites in the general geographical location. The predetermined depth at which downhole receiving system 50 is positioned may be higher than the estimated depth at which the signal is expected to become unreliable as determined via the aforementioned method to ensure adequate signal amplitude is received for reliable telemetry. In some cases, the depth at which downhole receiving system 50 is positioned is between 100 ft and 3500 ft above the depth at which telemetry is expected to become unreliable and in other cases the depth is between 500 ft and 2000 ft above the estimated depth at which telemetry is expected to become unreliable. In other embodiments, the predetermined depth selected for positioning of downhole receiving system 50 may be based on a known location of a formation of lower resistivity than adjacent formations. Without being bound by theory, a formation of lower resistivity than adjacent formations may provide a comparatively low resistance path for the signal resulting in a significant reduction in signal strength above the low resistivity formation. Formations such as, for example, salt zones, water saturated zones, and sands or sandstones with clay minerals or pyrite may have low resistivities compared to other formations. Knowledge of the formation type or direct measurement of the resistivity obtained from previous wells drilled in the general geographic location, then, may be used to determine the predetermined depth selected for positioning of downhole receiving system 50. In some embodiments, downhole receiving system 50 may be positioned below or within known low resistivity formations to increase the received telemetry signal strength.

In other embodiments, the predetermined depth selected for positioning downhole receiving system 50 may be the approximate depth of horizontal section 27*b* of wellbore 13*b*. In yet other embodiments, the predetermined depth selected for positioning downhole receiving system 50 may be the approximate depth of curve section 26*a* for wellbore 13*a* so that the force of gravity acting upon downhole receiving system 50 operates to force contact of the system with the casing string 28 of wellbore 13*a*. In yet other embodiments, the predetermined depth selected for positioning downhole receiving system 50 may be the depth predicted by an electro-magnetic attenuation model to produce the highest received signal level by downhole receiving system 50. Non-limiting examples of electro-magnetic attenuation models can be found in "Signal Attenuation for Electromagnetic Telemetry Systems", SPE/IADC 118872, Schnitger, et al., which is incorporated herein by reference.

In some embodiments, wireline 51 may be a mono-conductor; the mono-conductor may include a center conductor, often consisting of multiple strands and described hereinafter as an "insulated conductor", an insulating layer and an outer conductive sheath. In other embodiments, wireline 51 may include an additional insulating layer over the outer conductive sheath; the additional insulating layer may reduce undesirable noise currents, such as those generated by drilling equipment, from conducting onto the sheath and coupling into the insulated conductor of wireline 51. In yet other embodiments, wireline 51 may be a multi-conductor including multiple insulated conductors surrounded by a conductive sheath that may be surrounded by an additional insulating layer. Wireline unit 52 may include a depth measurement system such as, for example a draw works encoder, for measuring the depth of downhole receiving system 50 within wellbore 13*a*. Downhole receiving system 50 may include cable head 53, which may connect mechanically to the sheath of wireline 51, thus providing a weight bearing connection to downhole receiving system 50. Cable head 53 may further provide an insulated electrical connection to the insulated conductor of wireline 51.

In an embodiment, downhole receiving system 50 may be configured to operate as a single down-hole electrode, conducting the telemetry signal from EM telemetry system 30 to uplink receiver 36 at the surface. In such an embodiment, downhole receiving system 50 may include shorting adapter 54 connected, such as by threadable connection, to cable head 53 and electrically connecting the insulated conductor of wireline 51 to the body of shorting adapter 54, thereby shorting the insulated conductor of wireline 51 to downhole receiving system 50. In other embodiments, electrical connection of the insulated conductor of wireline 51 may be made in cable head 53, omitting shorting adapter 54. Wireline unit 52 may be configured with cable head 53 providing an insulated connection to the insulated conductor of wireline 51; however, use of shorting adapter 54 may save time associated with re-heading the wireline to short the insulated conductor of wireline 51 to cable head 53. Downhole receiving system 50 may further include centralizers 55 and 56 and weight bar 57 all fabricated from a conductive material such as, for example steel or brass. Centralizers 55 and 56 and weight bar 57 may be threadedly connected end to end, forming a single conducting electrode. In certain embodiments, a single centralizer may be used, such as centralizer 55 or centralizer 56. In other embodiments, centralizers 55 and 56 may be omitted. In yet other embodiments, weight bar 57 may be omitted. In yet other embodiments, shorting adapter 54 may be omitted.

Centralizers 55 and 56 may centralize the assembly within the cased wellbore and provide conductive contact from casing string 28 of wellbore 13*a* at contact points 58 to downhole receiving system 50. Centralizers 55 and 56 are diagrammatically represented as being of the leaf spring type configured to position downhole receiving system 50 in the middle of wellbore 13*a* but may be configured to position downhole receiving system 50 against the wall of casing string 28 in a "decentralized" configuration. Weight bar 57 adds weight to downhole receiving system 50 for conveyance of the assembly to the desired downhole location within wellbore 13*a*.

When configured as a downhole electrode, downhole receiving system 50 may conduct the telemetry signal from EM telemetry system 30 at contact points 58 through the insulated conductor of wireline 51 to uplink receiver 36. Uplink receiver 36 may measure the potential difference between contact points 58 and a surface electrode. In some embodiments, ground electrode 60 operates as a surface electrode. Ground electrode 60 may be connected to uplink receiver 36 by an insulated wire which may, in some embodiments, be shielded. In a non-limiting embodiment, ground electrode 60 may be a rod of conductive material such as, for example, copper or iron. In some embodiments, ground electrode 60 is positioned at a distance from drilling equipment 23, generator 29 and power cables connecting generator 29 to drilling equipment 23, which may reduce received noise. The distance between ground electrode 60 and drilling equipment 23, generator 29 and the connecting power cables may be between approximately 50 ft and 5000 ft or between approximately 200 ft and 1000 ft.

In another embodiment, the sheath of wireline 51 operates as a surface electrode. In such an embodiment, uplink receiver 36 is configured to measure the potential difference between the insulated conductor and conducting sheath of wireline 51. In some embodiments, the insulated conductor and sheath of wireline 51 are connected directly to the inputs of uplink receiver 36. In other embodiments, stranded or solid core wire may be used to connect the insulated conductor and sheath of wireline 51 to uplink receiver 36. In some embodiments, the insulated conductor and sheath of wireline 51 are connected to separate insulated conductors of a twisted pair cable for conducting the signal from wireline 51 to uplink receiver 36. In these embodiments, improved rejection of noise coupling into the signal through said cable may be achieved. The sheath of wireline 51 may be left ungrounded or attached via a wire to a ground stake near the wellhead of wellbore 13*a* or, preferably, located some distance away from drilling equipment 23 to reduce coupling of noise from the equipment into the sheath and from the sheath to the insulated conductor. The distance between the ground stake attached to the sheath of wireline 51 and drilling equipment 23 may be between 50 ft and 5000 ft or between 200 ft and 1000 ft. In other embodiments, the top of the casing or wellhead of wellbore 13*a* operates as a surface electrode and uplink receiver 36 is configured to measure the potential difference between the insulated conductor of wireline 51 and the top of the casing or wellhead of wellbore 13*a*. In other embodiments, part of drilling equipment 23 operates as a surface electrode and uplink receiver 36 is configured to measure the potential difference between the insulated conductor of wireline 51 and part of drilling equipment 23 such as, for example, the blow out preventer (BOP). In yet other embodiments, the casing or wellhead of another nearby wellbore operates as a surface electrode and uplink receiver 36 may be configured to measure the potential difference between the insulated conductor of wireline 51 and the casing or wellhead of another nearby wellbore.

In some embodiments, uplink receiver 36 may be configured as a switching mechanism to switch between any pair of surface electrodes or the insulated conductor of wireline 51 and any of the surface electrodes described above. In such an embodiment, the switching mechanism of uplink receiver 36 may be an electronic switch, a mechanical switch, or a patch panel or plug by which an operator manually switches between wires. In such an embodiment, uplink receiver 36 may switch between any pair of surface electrodes or the insulated conductor of wireline 51 and any of the surface electrodes described above so as to maximize the received signal to noise ratio. As a non-limiting example, when BHA 34 is drilling an upper portion of vertical section 25*b* of wellbore 13*b*, the largest signal to noise ratio may be received by configuring uplink receiver 36 to switch to measuring the potential difference between ground electrode 60 and ground electrode 61. As BHA 34 drills into the curve, however, signal to noise ratio may be maximized by configuring uplink receiver 36 to switch to measuring the potential difference between the insulated conductor of wireline 51 and the sheath of wireline 51.

Figure 2:
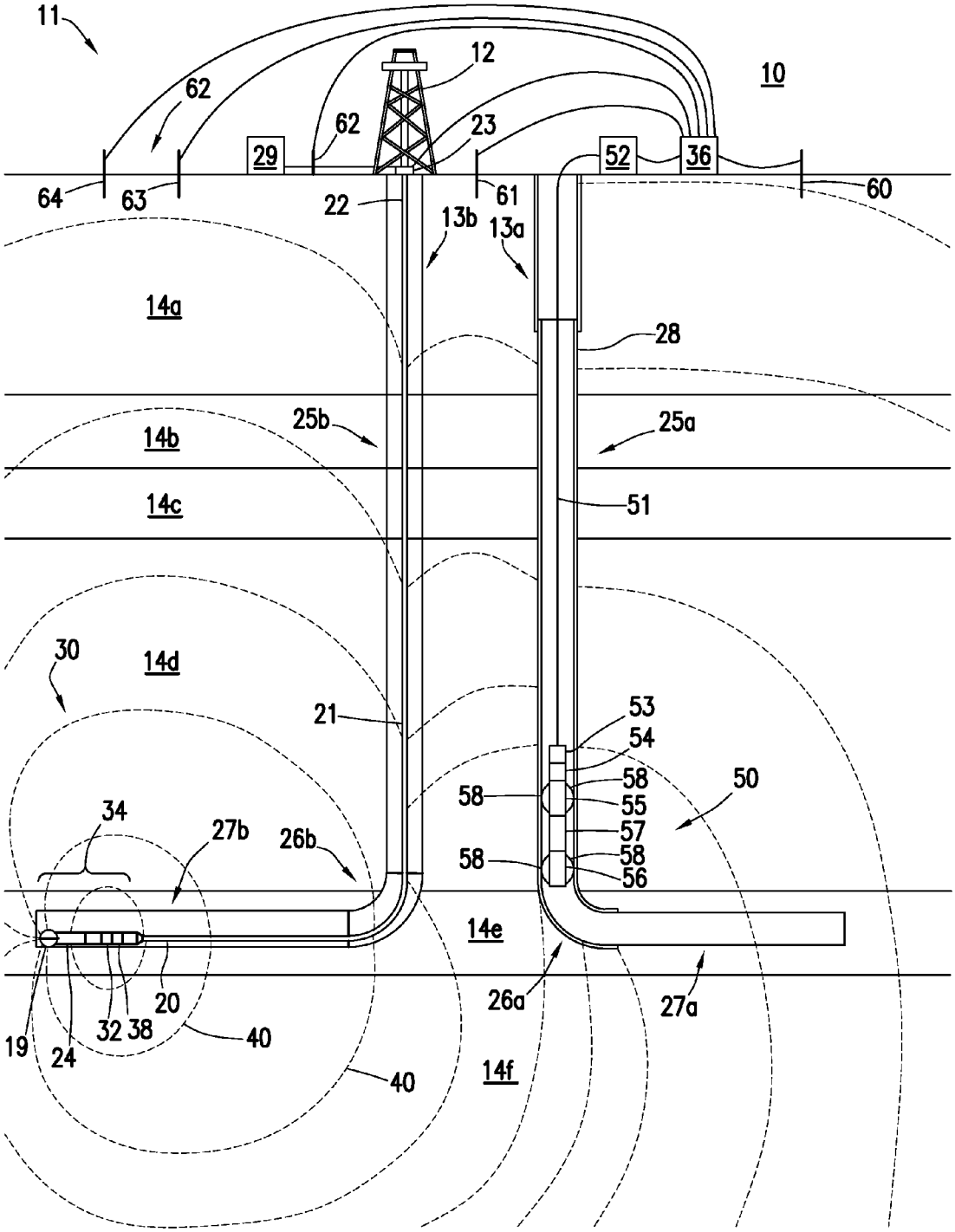
FIG. 2 is a schematic view of a drilling system consistent with embodiments of the present disclosure.

Referring now to FIG. 2, uplink receiver 36 may include a noise cancellation system for cancelling noise obtained from one or more noise sensors 62 employed to sense noise generated by, for example, motors used to raise or lower BHA 34 within wellbore 13*b*, operate drilling fluid pumps, rotate drill string 21, or other operations requiring electrical power to drill wellbore 13*b*. One non-limiting example of noise sensor 62 is a current sense coil. The current sense coil may consist of a coil wound around a rod shaped core of magnetic material such as, for example iron or permendur. The current sense coil may be placed adjacent and substantially perpendicular to one or more power cables supplying power from generator 29 to one or more pieces of drilling equipment 23. When current passes through power cables, a magnetic field may surround the cables. A portion of the magnetic field may pass through the magnetic core of current sense coil, which may induce a current in the coil of the current sense coil. The current sense coil may further include one or more resistors connected in series with the coil of the current sense coil that may operate to limit the induced voltage. Each end of the series arrangement of coil and one or more resistors of the current sense coil may be connected to two insulated wires, preferably in twisted pair arrangement, the ends of which may be connected to uplink receiver 36 as diagrammatically depicted in FIG. 2.

In another embodiment, a magnetometer with sensitive axis aligned substantially perpendicular to one or more power cables supplying power from generator 29 to one or more pieces or drilling equipment 23 may be used as noise sensor 62. Another non-limiting example of noise sensor 62 is a pair of electrodes such as, for example, ground electrodes 63 and 64, which may be of similar construction to ground electrodes 60 and 61, and may be positioned near generator 29, near the power cables connecting generator 29 to portions of drilling equipment 23 or near drilling equipment 23. In certain embodiments, the measured noise signal from ground electrodes 63 and 64 may also include a portion of the telemetry signal from EM telemetry system 30. In such embodiments, the process of cancelling noise from the received telemetry signal using the measured noise signal from ground electrodes 63 and 64 may result in a reduction in amplitude of the resultant noise cancelled telemetry signal, which may be undesirable due to a resultant decrease in signal to noise ratio. In some embodiments, ground electrodes 63 and 64 may be moved in relation to one another, the upper section 22 of drillstring 21, and generator 29 so as to reduce the amplitude of the telemetry signal of EM telemetry system 30 present in the measured noise signal from ground electrodes 63 and 64 and maximize the amplitude of the measured noise. Without being bound by theory, the amplitude of the telemetry signal present in the measured noise signal may be reduced by positioning ground electrodes 63 and 64 approximately equidistant radially from upper section 22 of drillstring 21 due to the tendency for the current of the telemetry signal of EM telemetry system 30 to return to drillstring 21 in a substantially radial direction. In some embodiments, then, the movement of ground electrodes 63 and 64 in relation to one another, the upper section of 22 of drillstring 21 and generator 29 may be guided by positioning ground electrodes 63 and 64 first approximately equidistant radially from upper section 22 of drillstring 21 and then adjusting from there so as to maximize the amplitude of the measured noise and minimize the amplitude of the telemetry signal of EM telemetry system 30 present in the measured noise signal.

In another embodiment, the sheath of wireline 51 may be used in combination with one of ground electrode 60, ground electrode 61, ground electrode 63, ground electrode 64 or an electrode attached to a portion of drilling equipment 23 such as, for example the BOP, or an electrode attached to the wellhead or casing of another nearby wellbore (not shown) as noise sensor 62. In yet other embodiments, any two of the aforementioned electrodes may be used as noise sensor 62. Uplink receiver 36 may be configured to simultaneously measure noise from two or more noise sensors as described above so that the measured noise from each noise sensor may be cancelled from the telemetry signal received via the aforementioned methods. Non-limiting methods for cancelling the noise may include use of an adaptive filter operating as a noise cancellation filter as described in "Noise cancellation using adaptive algorithms", *International Journal of Modern Engineering Research* (*IJMER*), Vol. 2, Issue 3, May-June 2012, pp-792-795, Chhikara, et al., which is incorporated herein by reference, or use of an optimal or Weiner filter. In some non-limiting embodiments, multiple adaptive or optimal filters may be cascaded or run in parallel to perform noise cancellation of more than one measured noise signal.

Figure 3:
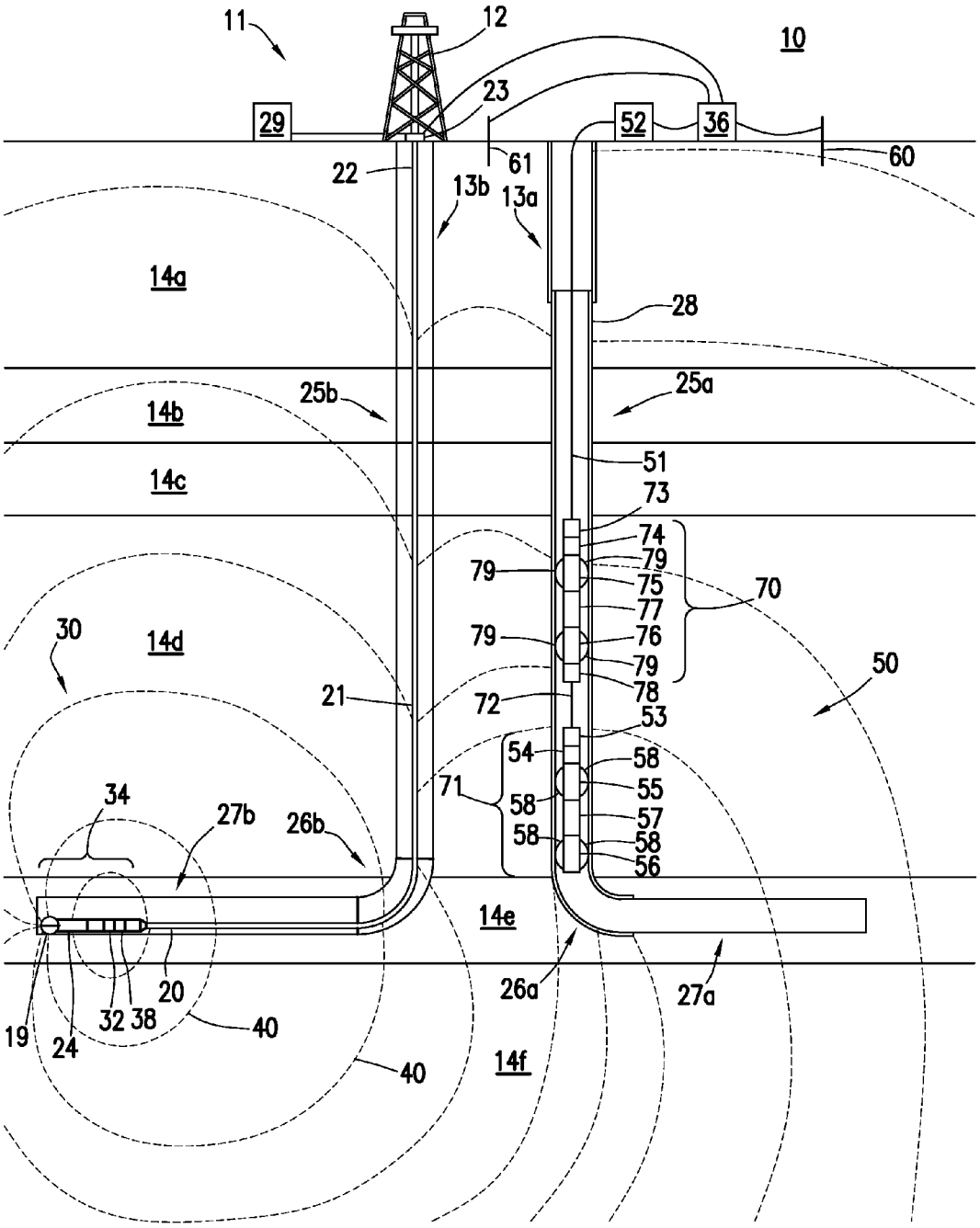
FIG. 3 is a schematic view of a drilling system consistent with embodiments of the present disclosure.

In other embodiments, downhole receiving system 50 may include two or more downhole electrodes separated by lengths of insulated wireline. Referring now to FIG. 3, downhole receiving system 50 may include two electrode assemblies 70 and 71 separated by wireline segment 72. Electrode assembly 70 may include cable head 73, downhole receiver 74, centralizers 75 and 76, power unit 77 and lower cable head 78, all of which may be threadedly connected. Cable head 73 may mechanically connect to the sheath of wireline 51, thereby providing a weight bearing connection to downhole receiving system 50. Cable head 73 may further provide insulated electrical connections to the one or more insulated conductors of wireline 51, which may be electrically connected to downhole receiver 74. Centralizers 75 and 76 centralize the assembly within the cased wellbore and provide a conductive contact from the casing of wellbore 13*a* at contact points 79 to downhole receiving system 50. Centralizers 75 and 76 are diagrammatically represented as being of the leaf spring type configured to position the downhole receiving system 50 in the middle of the wellbore 13*a* but may be configured to position downhole receiving system 50 against the wall of the casing of wellbore 13*a* in a "decentralized" configuration. Power unit 77 provides power to downhole receiver 74. In one non-limiting embodiment, power unit 77 is a battery.

In another non-limiting embodiment, power unit 77 is a power supply configured to convert power provided by wireline unit 52 and conducted down wireline 51 to downhole receiving system 50. Lower cable head 78 provides for mechanical and electrical connection to wireline segment 72. Wireline segment 72 may electrically connect electrode assembly 71 to electrode assembly 70. Wireline segment 72 may be of the mono-conductor or multi-conductor type and may have an insulated or non-insulated sheath. In yet another embodiment, wireline segment 72 may be replaced by a tubular or string of tubulars through which one or more insulated wires pass before connecting to electrode assembly 71. In such an embodiment, the tubular string may constructed of conducting members or, in other embodiments, may include one or more insulated members providing an isolated gap so that the bodies of electrode assemblies 70 and 71 are electrically isolated from one another except for the contact provided through casing string 28. Electrode assembly 71 may include cable head 53, shorting adapter 54, centralizers 55 and 56 and weight bar 57 may be threadedly connected. Cable head 53 may connect mechanically to the sheath of wireline segment 72 and provide insulated electrical connections to the one or more insulated conductors of wireline segment 72 to shorting adapter 54. Shorting adapter 54 may short one or more of the insulated conductors of wireline segment 72 to the body of shorting adapter 54. In some embodiments shorting adaptor 54, centralizers 55 and 56 and weight bar 57 may include additional insulated wires passed through to the lower end of electrode assembly 71 to allow for connection of additional electrode assemblies in like manner so that the insulated conductors of wireline segment 72 each connect to a separate electrode assembly each separated by a length of wireline.

With continued referenced to FIG. 3, in an embodiment, downhole receiver 74 may connect electrically via separate insulated connections to electrode assembly 70 and electrode assembly 71. Downhole receiver 74 may be adapted to measure the potential difference between electrode assembly 70 and electrode assembly 71. In such an embodiment, downhole receiver 74 may include electronics for filtering and amplifying the received telemetry signal. In some embodiments, downhole receiver 74 includes an automatic gain control circuit (AGC) or a programmable gain amplifier controlled by a micro-processor to adjust the gain of the receiver. The AGC or programmable gain amplifier may amplify the telemetry signal, in certain embodiments, without exceeding the output range of the amplifier. The filtered and amplified telemetry signal may be transmitted, such as by analog form, across the insulated conductor and sheath of wireline 51 when mono-conductor wireline is used or across two insulated conductors of wireline 51 when multi-conductor wireline is used. In some embodiments, downhole receiver 74 includes an analog to digital converter (ADC). When an ADC is used, the received telemetry signal may be transmitted in digital form over wireline 51 to uplink receiver 36. In other embodiments, the received telemetry signal may be transmitted up wireline 51 via an analog modulation method such as amplitude modulation (AM), phase modulation, frequency modulation or other modulation methods known in the art.

In another embodiment, downhole receiver 74 may include an electronic switch configured to switch between the filtered and amplified signal, the insulated wire connected to electrode assembly 70, and the insulated wire connected to electrode assembly 71. When an electronic switch is used, downhole receiving system 50 may switch between operating as a single electrode system connecting either electrode assembly 70 or 71 to uplink receiver 36 through wireline 51 or operating as two electrode system transmitting the filtered and amplified potential difference between electrode assemblies 70 and 71 to uplink receiver 36 through wireline 51. The switch may be controlled by the micro-processor of downhole receiver 74 and may switch from the filtered and amplified potential difference between electrode assemblies 70 and 71 and the insulated wire connected to electrode assembly 71 when the filtered and amplified signal strength drops below a pre-determined threshold. The predetermined threshold may be between 0.1 uV and 1 mV or may be between 1 uV and 10 uV and will generally be set to a level above the measured noise floor of the filtering and amplifying electronics of downhole receiver 74.

With further reference to FIG. 3, in another embodiment, wireline 51 is of the multi-conductor type, containing two or more insulated conductors, with one conductor electrically connected to electrode assembly 70 and one conductor connected to electrode assembly 71. In such an embodiment, downhole receiver 74 and power unit 77 may be omitted. The insulated conductors of wireline 51 may conduct signals from electrode assemblies 70 and 71 to uplink receiver 36. Uplink receiver 36 may be configured to measure the potential difference between the two electrodes. In another embodiment, uplink receiver 36 may be configured to switch between the wire connected to electrode assembly 70 or 71 and measure the potential difference between either the wire connected to electrode assembly 70 or 71 and one of a ground electrode 60, the sheath of wireline 51, the casing or wellhead of wellbore 13*a*, a portion of drilling equipment 23 such as, for example, the BOP, or the casing of wellhead of another nearby wellbore (not shown). As BHA 34 descends wellbore 13*b* during the drilling operation, uplink receiver 36 may switch between the wire connected to electrode assembly 70 and the wire attached to electrode assembly 71 so as to maximize the signal to noise ratio received. In such an embodiment, it may not be necessary to utilize wireline unit 52 for lowering a single electrode into wellbore 13*a* to maximize the signal to noise ratio received. In such an embodiment, the switching mechanism of uplink receiver 36 may be an electronic switch, a mechanical switch, or a patch panel or plug which an operator uses to manually switch between wires.

Figure 4:
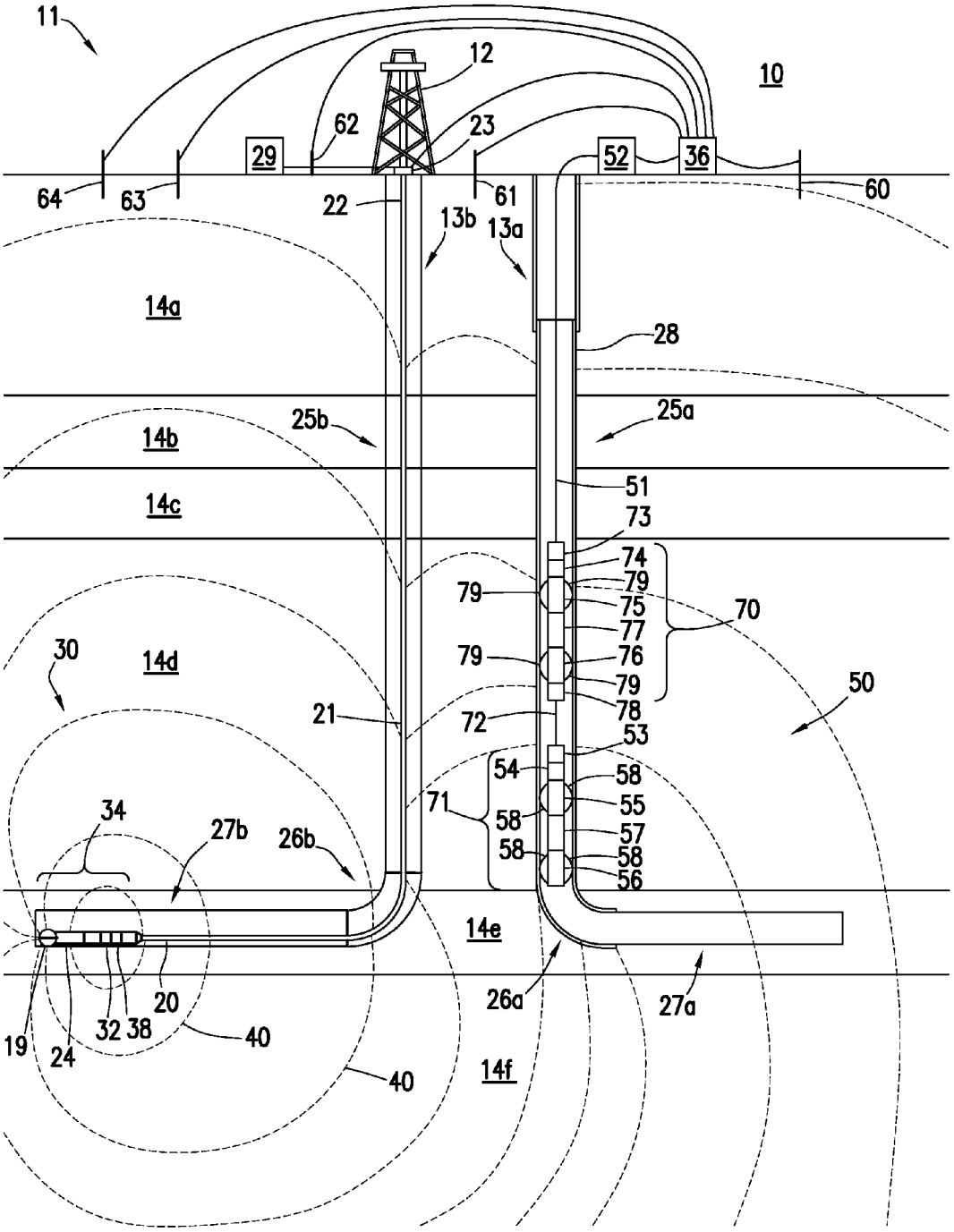
FIG. 4 is a schematic view of a drilling system consistent with embodiments of the present disclosure.

In the embodiment of FIG. 4, uplink receiver 36 may include a noise cancellation system for cancelling noise obtained from one or more noise sensors as previously described. The noise cancellation system may be used to cancel noise from the one or more telemetry signals from the one or more electrode assemblies of downhole receiving system 50.

Figure 5:
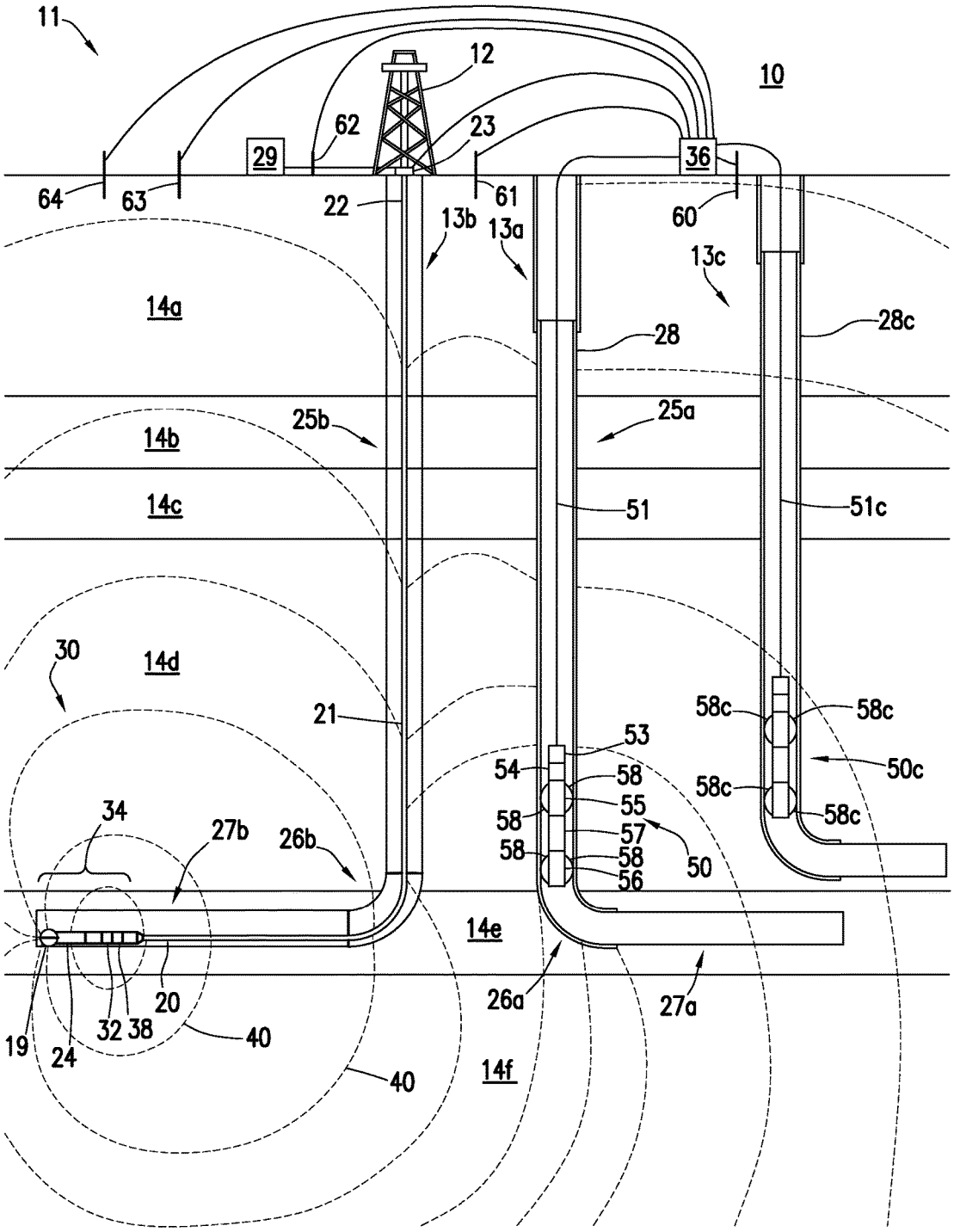
FIG. 5 is a schematic view of a drilling system consistent with embodiments of the present disclosure.

In the embodiment of FIG. 5, uplink receiver 36 may be configured to measure the potential difference between contact points 58 to casing string 28 in wellbore 13*a* and contact points 58*c* to casing string 28*c* in wellbore 13*c*. Downhole receiving system 50*c* may be suspended on wireline 51*c* from wireline unit 52. In such an embodiment, downhole receiving systems 50 and 50*c* may each be configured to operate as a single down-hole electrode as described above. Wireline unit 52 may be used to position, in sequence, downhole receiving system 50 and downhole receiving system 50*c* within wellbores 13*a* and 13*c* respectively. Any of the aforementioned methods for determining the depth of downhole receiving systems 50 and 50*c* may be used. In the embodiment of FIG. 5, uplink receiver 36 may include a noise cancellation system for cancelling noise from one or more noise sensors as described above. Use of downhole receiving systems 50 and 50*c* as a single downhole electrode may improve signal to noise ratio as compared to a single downhole receiving system.

In another embodiment, uplink receiver 36 is configured to simultaneously receive two or more telemetry signals obtained via any of the aforementioned methods and may combine the telemetry signals via diversity combining methods such as, for example, selection diversity, maximal ratio combining, or other optimal combining methods as indicated in "Performance Analysis of Conventional Diversity Combining Schemes in Rayleigh Fading Channel", "Eigen Theory for Optimal Signal Combining: A Unified Approach", "Optimum Combining in Digital Mobile Radio with Cochannel Interference", "The Optimal Weights of A Maximum Ratio Combiner Using An Eigenfilter Approach," all of which are incorporated herein by reference.

In some embodiments, uplink receiver 36 includes one or more variable resistors that may be switched across any pair of inputs previously indicated so as to modify the input resistance of uplink receiver 36 which may in some cases improve received signal to noise ratio. The variable resistors may be of the manually controlled potentiometer type or a digitally controlled resistor which can be controlled by a processor. In such an embodiment, the variable resistor switching mechanism of uplink receiver 36 may be an electronic switch, a mechanical switch, or a patch panel or plug that an operator uses to manually switch the variable resistors across any pair of inputs previously indicated. Uplink receiver 36 may also include a passive analog low pass or band pass filter, a differential or instrumentation amplifier powered off of an isolated power supply the ground of which may be tied to one of the inputs, an isolation amplifier, an automatic gain control circuit or programmable gain amplifier, a 50 or 60 Hz notch filter, and an active band-pass filter for each telemetry signal and noise sensor input. Uplink receiver 36 may also include one or more analog to digital converters and one or more microprocessors and associated memory, for sampling the ADCs, controlling the programmable gain amplifiers and performing digital filtering, noise cancellation, and optimal combining of signals as have been described.

In some embodiments bi-directional communication may be achieved by including a transmitter at the surface which may use any of the aforementioned down-hole electrode or surface electrode configurations for transmitting down to a receiver incorporated into EM telemetry system 30.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

drilling a section of a first wellbore;

casing a section of the first wellbore;

lowering a downhole receiving system into the first wellbore to a first wellbore first depth, the downhole receiving system including a centralizer formed of conductive material;

drilling a section of a second wellbore;

positioning an EM telemetry system in the section of the second wellbore;

transmitting an EM telemetry signal from the EM telemetry system; and receiving the EM telemetry signal with the downhole receiving system.

2. The method of claim 1, wherein the EM telemetry system comprises an uplink transmitter and wherein the uplink transmitter is positioned at a second wellbore first depth.

3. The method of claim 2, wherein the first wellbore first depth is proximate the second wellbore first depth.

4. The method of claim 2, wherein the downhole receiving system is maintained at the first wellbore first depth.

5. The method of claim 4, wherein the first wellbore first depth is determined based on a known low resistivity formation depth.

6. The method of claim 4, wherein the first wellbore first depth is determined based on the estimated depth at which the EM telemetry signal drops into the noise level.

7. The method of claim 6, wherein the estimated depth is determined during drilling of the first wellbore, during drilling of a section of the second wellbore, or during drilling of a third wellbore.

8. The method of claim 6, wherein the first wellbore first depth is between 100 feet and 3500 feet above the estimated depth.

9. The method of claim 4, wherein the first wellbore first depth is within a salt zone, water saturated zone, or sands or sandstones with clay minerals or pyrite.

10. The method of claim 4, wherein the first wellbore first depth is below a salt zone, water saturated zone, or sands or sandstones with clay minerals or pyrite.

11. The method of claim 4, wherein the second wellbore has a horizontal section, and wherein the first wellbore first depth is at the depth of the horizontal section of the second wellbore.

12. The method of claim 4, wherein the first wellbore has a curve section and wherein the first wellbore first depth is at the depth of the curve section.

13. The method of claim 4, wherein the first wellbore first depth is determined based on an electro-magnetic attenuation model.

14. The method of claim 2 further comprising:

positioning the EM telemetry system to a second wellbore second depth, wherein the second wellbore second depth is lower than the second wellbore first depth; and lowering the downhole receiving system to a first wellbore second depth, wherein the second wellbore second depth and the first wellbore second depth are proximate.

15. A system comprising:

a downhole receiving system positioned in a first wellbore at a first wellbore depth, the downhole receiving system suspended from a wireline, the wireline having a sheath and an insulated conductor, the downhole receiving system configured to operate as an electrode, the downhole receiving system including a centralizer formed of a conductive material;

an uplink receiver; and an EM telemetry system positioned in a second wellbore, the EM telemetry system having an uplink transmitter, the uplink transmitter located at a second wellbore first depth.

16. The system of claim 15, wherein the EM telemetry system comprises a BHA and wherein the uplink transmitter is located on the BHA.

17. The system of claim 16, wherein the BHA includes an electrically insulating gap across which a voltage is impressed or a toroid.

18. The system of claim 15, wherein the wireline is a mono-conductor or a multi-conductor.

19. The system of claim 15, wherein the downhole receiving system is configured to operate as a single electrode.

20. The system of claim 19, wherein the downhole receiving system comprises a cable head, the cable head electrically connected to the insulated conductor.

21. The system of claim 19, wherein the downhole receiving system comprises a shorting adaptor, the shorting adaptor having a body, and a cable head, wherein the cable head is connected to the shorting adaptor and the shorting adaptor body is electrically connected to the insulated conductor.

22. The system of claim 19 further comprising one or more centralizers, the one or more centralizers comprised of a conductive material.

23. The system of claim 19 further comprising a weight bar, the weight bar comprised of a conductive material.

24. The system of claim 19, wherein the centralizers further comprise one or more contact points, the one or more contact points being in electrical connection with the first wellbore.

25. The system of claim 24, wherein the uplink receiver comprises at least one surface electrode.

26. The system of claim 25, wherein the at least one surface electrode is a ground electrode.

27. The system of claim 25, wherein the uplink receiver is adapted to measure the potential difference between the insulated conductor and the surface electrode.

28. The system of claim 25, wherein the at least one surface electrode is a single electrode.

29. The system of claim 25, wherein the at least one surface electrode is the wireline sheath, the top of a casing, the top of the wellhead, a part of rig equipment, a casing of a nearby wellbore, or the wellhead of a nearby wellbore.

30. The system of claim 29, wherein the at least one surface electrode is the wireline sheath and the uplink receiver is adapted to measure a potential difference between the insulated conductor and the wireline sheath.

31. The system of claim 29, wherein the at least one surface electrode is the top of the casing or the top of the wellhead and the uplink receiver is adapted to measure a potential difference between the insulated conductor and the top of the wellhead or the top of the casing.

32. The system of claim 29, wherein the at least one surface electrode is a part of rig equipment and the uplink receiver is adapted to measure a potential difference between the insulated conductor and the part of rig equipment.

33. The system of claim 29, wherein at least one surface electrode is the casing of the nearby wellbore or the wellhead of the nearby wellbore and the uplink receiver is adapted to measure a potential difference between the insulated conductor and the casing of the nearby wellbore or the wellhead of the nearby wellbore.

34. The system of claim 29, wherein the uplink receiver further comprises a switching mechanism, the switching mechanism configured to switch between the downhole receiving system and the surface electrode.

35. The system of claim 34, wherein the switching mechanism is an electronic switch, a mechanical switch, a patch panel, or a plug.

36. The system of claim 29, wherein the at least one surface electrode comprises two surface electrodes selected from the group consisting of one or more ground electrodes, the wireline sheath, the top of a casing, the top of the wellhead, a part of rig equipment, a casing of a nearby wellbore, or the wellhead of a nearby wellbore.

37. The system of claim 15, wherein the uplink receiver comprises a noise cancellation system having one or more noise sensors.

38. The system of claim 37, wherein the noise sensor comprises a current sense coil, a magnetometer having a sensitive axis aligned substantially perpendicular to one or more power cables, a pair of noise sensor ground electrodes, the wireline sheath in combination with a surface electrode or a noise sensor ground electrode, or a combination thereof.

39. The system of claim 37, wherein the noise sensor comprises a pair of noise sensor ground electrodes, wherein the noise sensor ground electrodes are adapted to move in relationship to each other.

40. The system of claim 39, wherein the noise sensor ground electrodes are spaced approximately equidistant radially from a drill string positioned in the second wellbore.

41. The system of claim 39, wherein the noise sensor ground electrodes are spaced based on a measurement of noise.

42. The system of claim 15 wherein the downhole receiving system is configured to operate as two or more electrodes.

43. The system of claim 15, wherein the downhole receiving system comprises a first electrode and a second electrode, the first electrode and the second electrode electrically connected by a wireline segment.

44. The system of claim 43, wherein the first electrode comprises a first electrode cable head, a first electrode downhole receiver, one or more first electrode centralizers, a first electrode power unit and a lower cable head in electrical connection, wherein the first electrode cable head is mechanically connected to the sheath of the wireline and lower cable head is mechanically connected to the wireline segment.

45. The system of claim 44, wherein the second electrode comprises a second electrode cable head, a shorting adaptor, one or more second electrode centralizers, and a weight bar, wherein the second electrode cable head is electrically connected to the wireline segment.

46. The system of claim 45, wherein the downhole receiver is electrically connected to the first electrode and the second electrode.

47. The system of claim 40, wherein the downhole receiver is adapted to measure the potential difference between the first electrode and the second electrode.

48. The system of claim 40, wherein the downhole receiver comprises an automatic gain control or a programmable gain amplifier.

49. The system of claim 40, wherein the downhole receiver further comprises an electronic switch, the electronic switch adapted to switch between a filtered and amplified signal, the first electrode, and the second electrode.

50. The system of claim 15, wherein the uplink receiver further comprises one or more variable resistors.

51. The system of claim 50, wherein the variable resistors are potentiometers or digitally controlled resistors.

52. The system of claim 50, wherein the uplink receiver further comprises a resistor switching mechanism, wherein the resistor switching mechanism is an electronic switch, a mechanical switch, or a patch panel or plug.

53. The system of claim 15 further comprising a second downhole receiving system positioned in a third wellbore at a third wellbore depth, the second downhole receiving system suspended from a second wireline, the second wireline having a sheath and an insulated conductor, the downhole receiving system and the second downhole receiving system configured to operate as a single electrode.

54. A method comprising:

providing a downhole receiving system, the downhole receiving system configured to operate as an electrode, the downhole receiving system including a centralizer formed from a conductive material;

suspending the downhole receiving system from a wireline at a first wellbore depth, the wireline having a sheath and an insulated conductor such that one or more contact points of the centralizer are in electrical connection with the wellbore;

locating an uplink receiver at the surface, the uplink receiver in electrical communication with the downhole receiving system;

positioning an EM telemetry system in a second wellbore, the EM telemetry system having an uplink transmitter, the uplink transmitter located at a second wellbore first depth;

positioning a plurality of pairs of surface electrodes at the surface; and switching the uplink receiver from a first pair of electrodes at the surface to a second pair of electrodes at the surface, or from the insulated conductor and a surface electrode to one of a pair of the plurality of electrodes.

55. The method of claim 54, wherein the switch from a first pair of electrodes at the surface to a second pair of electrodes at the surface, or from the insulated conductor to one of a pair of the plurality of surface electrodes is based on the signal to noise ratio.

56. The method of claim 1, wherein the centralizer comprises one or more contact points, the one or more contact points in electrical connection with the first wellbore.

57. The method of claim 1, wherein the downhole receiving system further comprises a shorting adaptor, the shorting adaptor having a body and a cable head, wherein the cable head is connected to the shorting adaptor and the shorting adaptor body is electrically connected to a wireline.

58. The system of claim 15, wherein the centralizer comprises one or more contact points, the one or more contact points in electrical connection with the first wellbore.

59. The system of claim 15, wherein the downhole receiving system further comprises a shorting adaptor, the shorting adaptor having a body and a cable head, wherein the cable head is connected to the shorting adaptor and the shorting adaptor body is electrically connected to the insulated conductor.

60. The method of claim 54, wherein the downhole receiving system further comprises a shorting adaptor, the shorting adaptor having a body and a cable head, wherein the cable head is connected to the shorting adaptor and the shorting adaptor body is electrically connected to the insulated conductor.

61. The method of claim 1, wherein receiving the EM telemetry signal with the downhole receiving system comprises:

measuring, with an uplink receiver the potential difference between the downhole receiving system and a surface electrode, the uplink receiver coupled to the downhole receiving system by an insulated conductor.

62. The method of claim 61, wherein the surface electrode is a ground electrode.

63. The method of claim 61, wherein the surface electrode is a sheath of a wireline that includes the insulated conductor, the top of a casing, the top of the wellhead, a part of rig equipment, a casing of a nearby wellbore, or the wellhead of a nearby wellbore.

64. The method of claim 63, wherein the surface electrode is the top of the casing or the top of the wellhead and the uplink receiver is adapted to measure a potential difference between the insulated conductor and the top of the wellhead or the top of the casing.

65. The method of claim 63, wherein the surface electrode is a part of rig equipment and the uplink receiver is adapted to measure a potential difference between the insulated conductor and the part of rig equipment.

66. The method of claim 63, wherein surface electrode is the casing of the nearby wellbore or the wellhead of the nearby wellbore and the uplink receiver is adapted to measure a potential difference between the insulated conductor and the casing of the nearby wellbore or the wellhead of the nearby wellbore.

67. The method of claim 61, further comprising:

drilling a section of a third wellbore;

casing a section of the third wellbore;

lowering a second downhole receiving system into the third wellbore to a third wellbore first depth, the uplink receiver coupled to the second downhole receiving system by a second insulated conductor; and measuring the potential difference between the first downhole receiving system and the second downhole receiving system.

* * * * *